United States Patent [19]

Ebert

[11] 4,320,869

[45] *Mar. 23, 1982

[54] FLUE GAS TRAP AND DIVERTER

[76] Inventor: Edward A. Ebert, 203 Huxley Dr., Snyder, N.Y. 14226

[ * ] Notice: The portion of the term of this patent subsequent to Aug. 5, 1977, has been disclaimed.

[21] Appl. No.: 135,529

[22] Filed: Mar. 31, 1980

Related U.S. Application Data

[63] Continuation-in-part of Ser. No. 866,458, Jan. 3, 1978, Pat. No. 4,215,814.

[51] Int. Cl.[3] ..... F23J 11/02

[52] U.S. Cl. ..... 236/1 G; 126/307 R; 126/307 A; 165/DIG. 2

[58] Field of Search ..... 126/307 A, 307 R, 299, 126/312; 165/DIG. 2, DIG. 12, 137; 236/1 G

[56] References Cited

U.S. PATENT DOCUMENTS 1,438,611 12/1922 Ryerson ..... 126/307 R 4,215,814 8/1980 Ebert ..... 236/1 G

*Primary Examiner*—Albert J. Makay
*Assistant Examiner*—Henry Bennett

[57] ABSTRACT

An energy conserving device for preventing loss of heat energy from a heater to a chimney by means of a fluid gas heat trap to choke off either chimney draft and/or heated convectional air currents lost to the chimney when the heater is OFF but allowing combustion gasses to vent freely to the chimney when such gasses are generated. The deivce also acts as a diverter for either up or down drafts from the chimney to direct them away from the heater. In another form when the device is used with a forced air type furnace, the device in addition provides heat interchange between room air and the hot gasses in the trap. This then heated air is drawn into the circulating system of the furnace adding to its temperature while lowering the temperature of the vented combustion gasses, to lessen the heat loss up the chimney.

11 Claims, 13 Drawing Figures

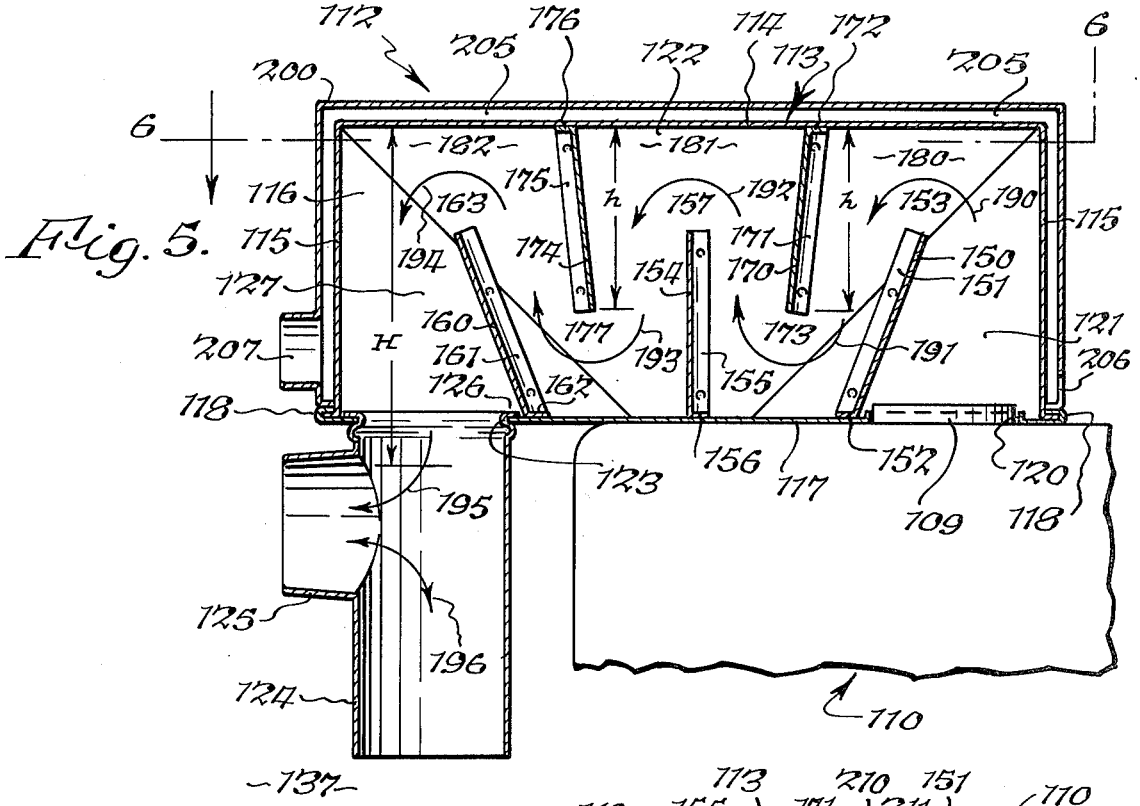
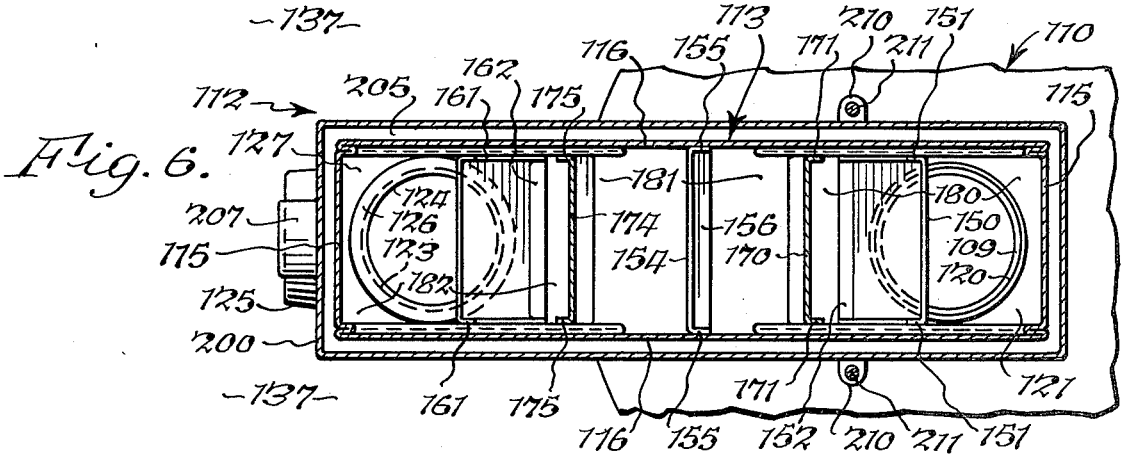
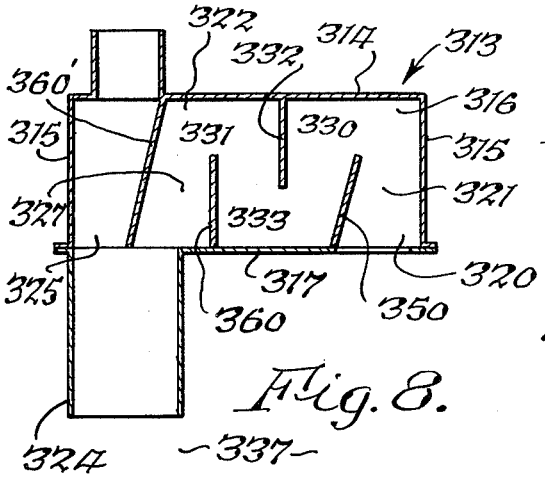
Fig. 8.
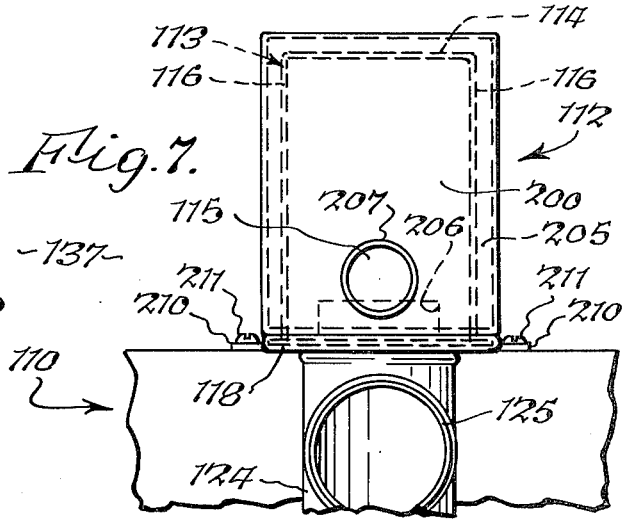

Fig. 9.
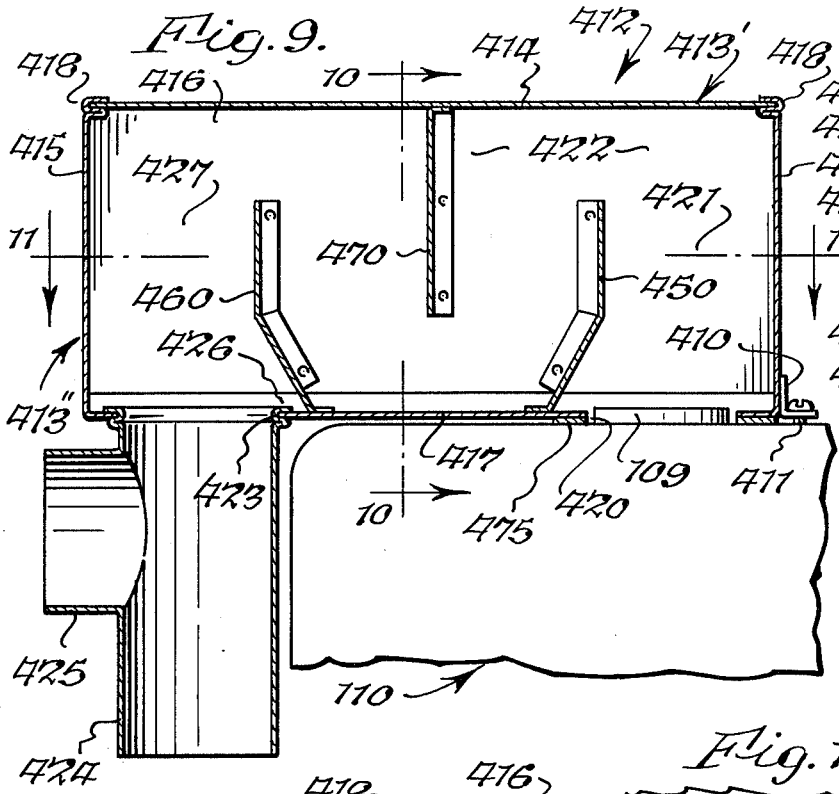
Fig. 10.
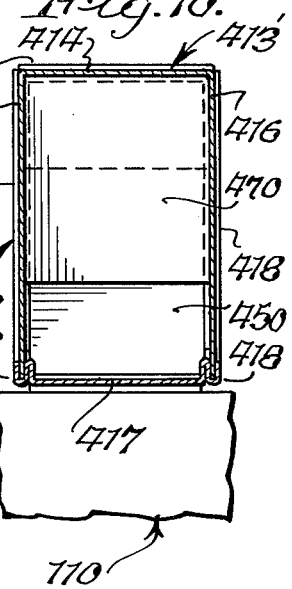
Fig. 11.
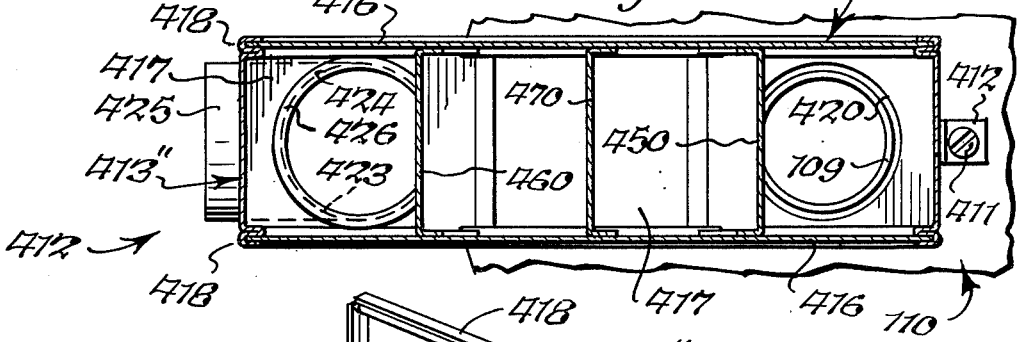
Fig. 12.
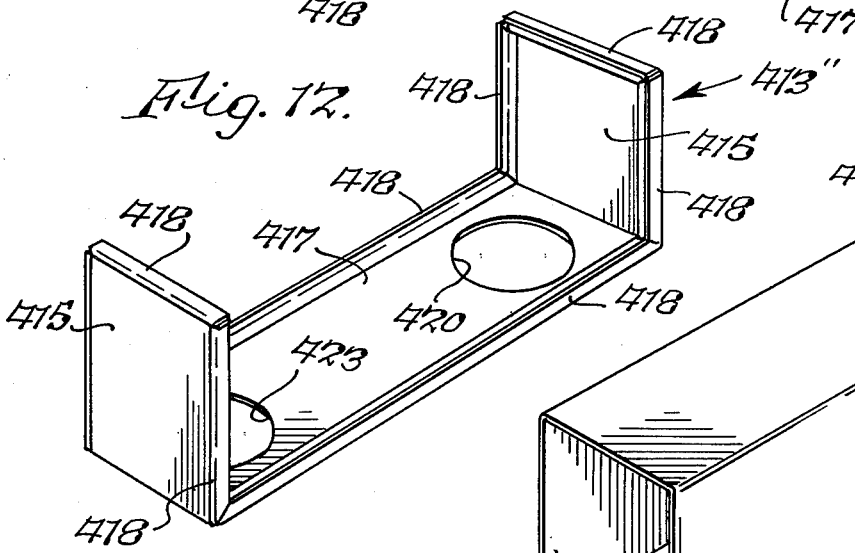
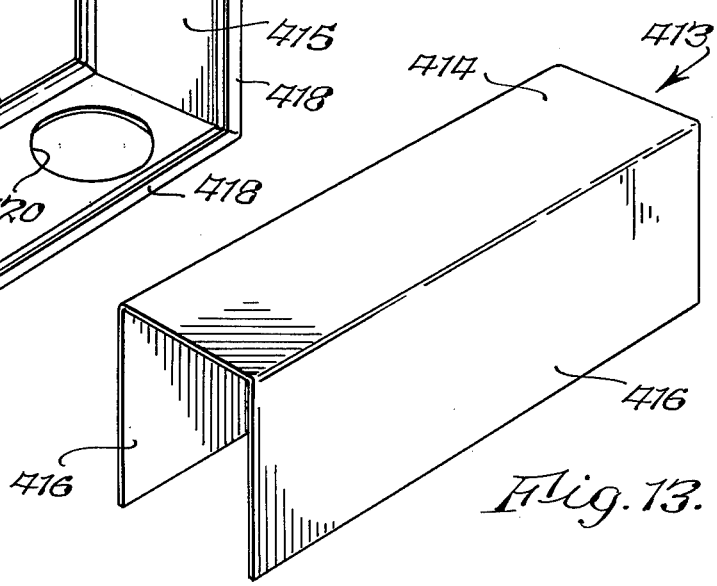
Fig. 13.

FLUE GAS TRAP AND DIVERTER

This application is a continuation-in-part of application Ser. No. 866,458 filed Jan. 3, 1978, now U.S. Pat. No. 4,215,814.

BACKGROUND OF THE INVENTION

This invention relates to a heat energy conservation device for use with heating equipment, wherein the heater is ON and doing its heating and then again is OFF because it has done its work. In either case heat loss occurs and it is the minimizing of this heat loss that the invention is directed to. The term heater used herein includes furnaces, hot water boilers, not water tanks and heating apparatus of various types using gas, oil and other fuels requiring connection to a chimney.

More particularly the present invention relates to a choke in the form of an inverted U, V, or L shape combined with the flue of the heater to form a fluid trap. This trap employed between the flue of the heater and the chimney, chokes off hot air from its heat interchange surfaces while in an OFF or non-heating mode to eliminate this large loss of heat energy. Heaters such as these by their very nature and design are both heat absorbers as well as heat exchangers. Their nature does not change when they are changed from an OFF mode where their burner is OFF to an ON mode where their burner is ON or vice versa. They still act as heat exchangers and thereby promptly lose the heat they had gained to return to the ambient temperature of their environment.

One problem with the present flue connections used, which in many cases are mandatory by local laws, is the inclusion of a draft deflector or diverter usually placed at the top of the heater and then piped to the chimney. By virtue of its location, at the top of the heater, it is constantly taking away heated air lost from heating areas of the heater and also warm room air and delivering it to the chimney and out of the living space, a complete loss and waste of this heat energy. Also by being located at the top of the heater it is drawing room air from a stratum of, warmer than average room air.

The present invention uses the principle of a deflector or so called draft diverter, to take advantage of its usefulness and compliance to the safety laws but places it lower and to the side of the heater where it takes air from a lower stratum and a lower temperature, to reduce the thermal loss when evacuating room air. Of greater importance is the fact that the present invention further chokes off the lost hot air of the appliance to slow down the reverse heat transfer of its heating surfaces when the burner is OFF but yet does not impede the flow of hot combustion gasses through to the chimney when the burner is ON. The choking off of hot gasses also gradually lowers the chimney temperature and this then in turn lowers its motivation to draw as strongly as when hotter.

A principal object of this invention is to provide an attachment which allows free flow of hot gasses from a heater to a chimney when the heater is ON and which chokes off the flow of hot gasses when the heater is OFF to retain residual heat energy.

Another main object is to utilize all of the interior space in the overall displacement of the device to accomplish the maximum choke effect by stratification of the hot gasses.

A further object is to obtain that just mentioned object with the minimum amount of material in its make up.

Another object is to provide a choke without moving parts, which works by the natural law of gravity and changes its mode of ON or OFF by its confrontation with temperature and pressure of the flue gasses.

A still further object is to use the invention as a heat exchange device as well as a trap when in the ON mode to retain additional energy for the user.

Another object is to provide a choke chamber having a pan part formed from a folded single sheet of material.

One other object is to provide a choke chamber having a top plate with depending side walls and a base plate with upstanding side walls, each complimenting the other to form the closed choke chamber.

SUMMARY

This invention provides a means to prevent heat loss from a heating apparatus which has residual or stored heat energy. The natural law of gravity either lets the flow of hot gasses pass through the device freely or chokes off the flow of gasses by the stratification of these gasses in the trap chambers provided. Further saving of heat energy can be accomplished by using the device as a heat interchanger to return normally lost heat energy back into the heating system.

BRIEF DESCRIPTION OF THE DRAWINGS

The present invention as well as further objects and features thereof will be understood more clearly and fully from the following detailed description of the preferred embodiment, when read in conjunction with the accompanying drawings, in which;

FIG. 5 is a vertical, central, longitudinal section similiar to FIG. 1 of a modified construction, FIG. 6 is a horizontal section, looking downwardly and taken along line 6—6 in FIG. 5, FIG. 7 is an end elevational view, taken from the left of FIG. 5, FIG. 8 is a vertical longitudinal section of a modification illustrated diagramatically, FIG. 9 is a vertical, central, longitudinal section similiar to FIG. 1 of another construction, FIG. 10 is a vertical cross section on line 10—10 of FIG. 9, FIG. 11 is a horizontal section, looking downwardly along line 11—11 of FIG. 9 and FIGS. 12 and 13 are perspective of a top part and a bottom part of FIG. 9.

GENERAL OPERATION

The cause and effect of the operation of the traps in the ON or free flow mode or in the OFF or choke mode as applied to heaters is elaborated in great detail in the previous application, Ser. No. 866,458, U.S. Pat. No. 4,215,814, so here only a brief review of operation will be explained.

When the trap is confronted with a pressurized fast flow of combustion gasses at a high temperature and large volume, it freely passes these gasses. The resistance to up and down flow in the trap is partially overcome by a siphoning effect.

Contrarily though when the trap confronts a slow flow of gasses of relatively low temperature and at small volume, it will allow, and aid in, the stratification of these gasses in stratta or layers, higher temperature gasses at the top and lower temperature gasses at the bottom to stifle and choke off the flow of gasses through the trap.

DETAILED DESCRIPTION

Figure 1:
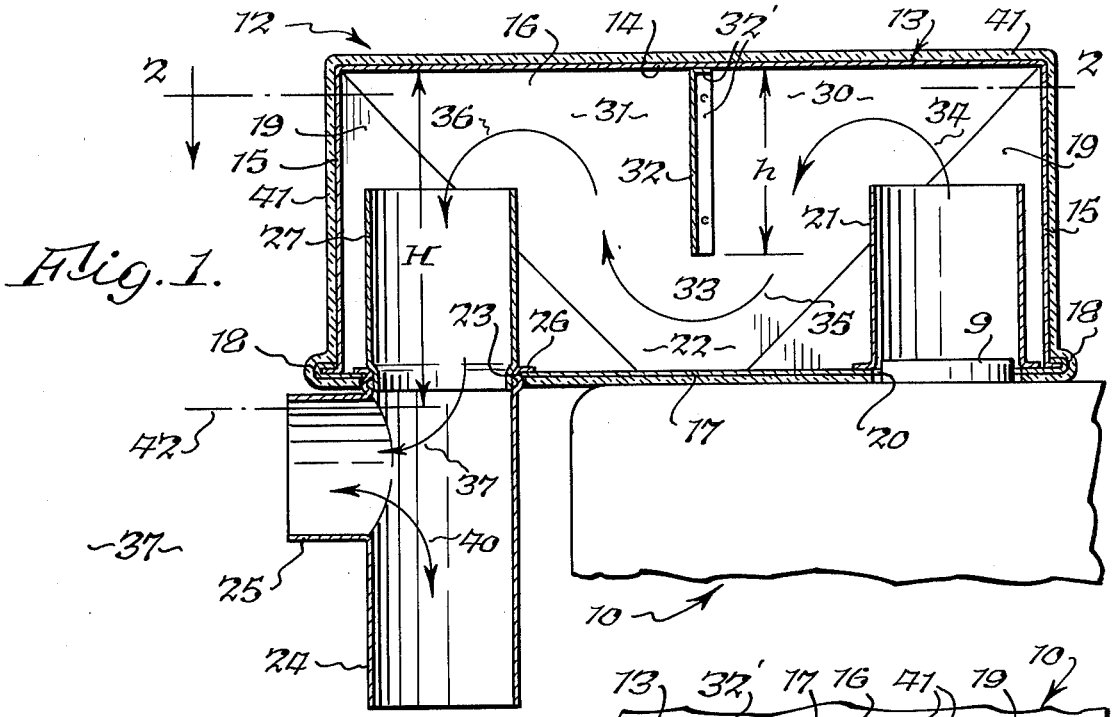
FIG. 1 is a central vertical longitudinal section of a hot gas trap fitted onto a heater.
Figure 2:
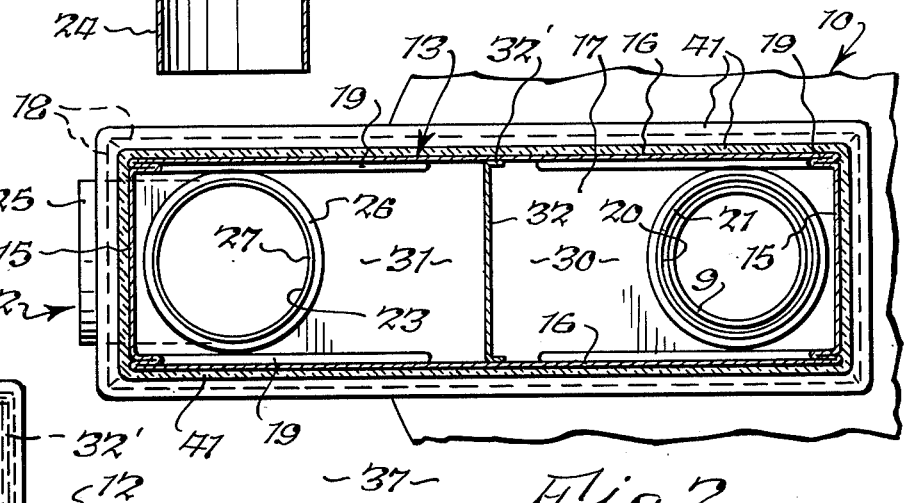
FIG. 2 is a horizontal section taken along line 2—2 of FIG. 1, looking downwardly.
Figure 3:
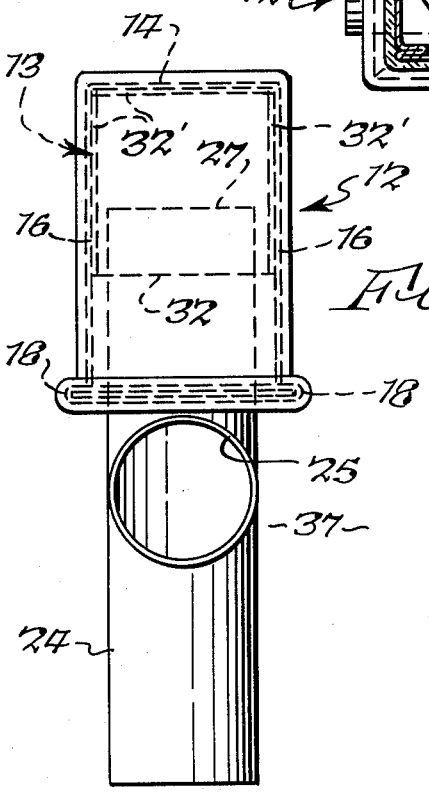
FIG. 3 is an end elevational view of FIG. 1 from the left.
Figure 4:
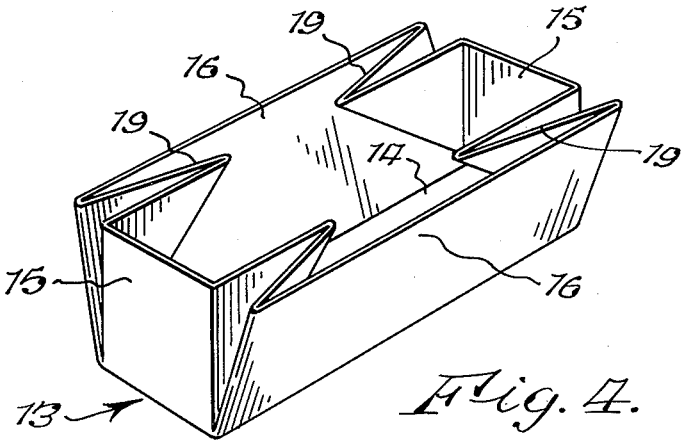
FIG. 4 is a perspective view of a choke chamber constructed of a single retangle of sheet metal with gusseted folds at its corners.

In FIGS. 1, 2 and 3 is shown a hot gas trap 12 positioned on a heater 10 having a flue 9. The trap 12 may be comprised of an inverted pan shaped housing 13 having a top wall 14 with depending end walls 15 and side walls 16 with the openside closed by a base plate 17 having a sealed periferal fastening 18. These parts 13, 14, 15, 16 and 17, combined from the horizontal leg or an elongated chamber 22 for the trap 12.

An opening 20 in the base plate 17 is provided with an upstanding heater connection 21. This duct 21 extends a distance somewhat greater than half of the height of the side and end walls 15 and 16, into the interior of the elongated chamber 22, inside of the top wall 14, end walls 15, side walls 16 and the base plate 17.

At its other end the base plate 17 is provided with another opening 23 which is provided with a depending tubular shroud portion 24 which has a chimney connection duct 25 fitted to it just below the base plate 17. The mounting of the shroud 24 into the opening 23 may be made in a conventional flaring fastening means 26 with sufficient looseness to allow for 360° rotation.

Fastened to the flared end of shroud 24 in any suitable manner is a chimney leg duct 27 which projects upwardly into the chamber 22 a distance somewhat greater than one half of the height of the side and end walls 16 and 15 similar to the heater connection duct 21, just explained.

Although the chimney leg duct 27 is shown fastened to the shroud portion 24 it could just as easily be stationarly fixed to the top side of the base plate 17 instead.

The chamber 22 is divided into two connected trap compartments, a first stage compartment 30 and a second stage compartment 31 by a baffle plate 32 having flanges 32'. Baffle plate 32 depends downwardly from the top wall 14 a distance somewhat greater than one half of the height of the side and end walls 16,15 and may be fastened in any suitable manner to walls 14,15,16. The space below the lower end of baffle 30 and base plate 17 provides a through passage 33 between the compartments 30,31 and provides a fluid connection between the heater connection duct 21 and the chimney leg duct 27.

As can be seen by the flow arrows 34,35,36 and 37 there is a clear communication passage for gasses from the heater connection duct 21, compartment 30, passage 33 compartment 31, chimney leg duct 27 into shroud 24 and to the chimney via the chimney connection 25.

The upstanding heater connection duct 21 and chimney leg duct 27 with the downstanding baffle plate 32 all contained in the chamber 22 now function as a pair of gas traps, a first stage in the compartment 30, and a second stage in the compartment 31.

The construction described thus far constitutes a hot gas trap 12 similar to that shown in any application Ser. No. 866,458, U.S. Pat. No. 4,215,814 with the exception that the heater connection duct 21 and the chimney leg duct 27 are inverted and inserted inside of the choke chamber 22, instead of extending away and outside of the chamber 22. This conserves and makes use of space that was not used and in addition provides a gas trap with two gas trap stages 30,31 rather than only one, thus making a more effective choke. The head h is now added to the head H giving a greater choking effect. If the same size scale is used relative to FIG. 10 of the previous application, that being one, the form shown in this application FIG. 1 would equal one and three quarters.

The chimney connection 25 being placed at a right angle to the shroud duct 24 effectively shields the heater by diverting the down drafts from the chimney into the environ space 37 as indicated by the arrow 40.

Pan shaped housing 13 and base plate 17 which comprise the trap 12 is covered with a thickness of insulation 41 to help retain heat in the trap to its highest temperature for best stratification when in the choke mode.

The housing 13 might be fabricated by deep drawing and stretching the metal into form as well as other fabricating means, however the housing 13 shown in FIGS. 1–4 is fabricated from a single rectangular sheet of metal by using a brake machine, Four folded pleats 19 at the corners are then turned inwardly along the inside or outside of one of the side or end walls 15,16 to form the housing 13.

It is also contemplated that this housing 13 might also be cast en-bloc of suitable material that in this form might combine the qualities required for structural strength and thermal insulation.

A further modified construction is shown in FIGS. 5–7 wherein three stages of choking are included in the same size and space required by the invention shown in FIGS. 1–4.

Similar terms are used here with the numbered parts having the prefix 1 added thereto.

The hot gas trap 112 comprises a similar pan shaped housing 113 having a top wall 114 with depending end and side walls 115,116. The openside is closed by a base plate 117 in a sealed relationship 118 to the periferal edges of the housing 113 as at 118.

Trap 112 is shown as fitting onto the top of a heater 110. Its base plate 117 is provided at one end with an opening 120 and another opening 123 at the other end. Opening 120 fits around the heater flue 109 to conduct flue gasses into a heater connection duct 121 formed in the interior of chamber 122 of housing 113 by a first baffle plate 150.

Plate 150 has side flanges 151 and a bottom flange 152. It may be fastened to the side walls 116 by flanges 151 or if preferred to base plate 117 by its bottom flange 152.

A similar center baffle plate 154 has side flanges 155 and a bottom flange 156 and another similar last baffle plate 160 forms the chimney leg duct 127. It Has side flanges 161 and a bottom flange 162. Both plate 154 and 160 may be mounted as explained above for plate 150. The upper ends of these baffles 150, 154 and 160 spaced from the wall 114 form the flow passages 153, 157 and 163.

Between the upstanding baffles 150 and 154 is another 170, depending from the top wall 114 and fastened thereto by its flange 172 and side flanges 171 to the side walls 116. The lowermost end of baffle plate 170 extends short of base plate 117 to provide a passage space 173.

Similarly baffle plate 174 extends down from top wall 114 between the plates 154, 160, short enough to form a passage space 177.

In the opening 123 of the base plate 117 a shroud portion or duct 124 is flared as at 126 which allows for 360° rotation. A chimney connection 125 is provided on the shroud 124 for venting to a chimney.

It can now be seen that the intermeshing of the upper baffles 171, 174 with the lower baffles 150, 154 and 160 provide three trap compartments 180, 181 and 182 for the stratification of the passive gasses when the heater is in the OFF mode. Hot gasses from the flue 109 of the heater 110 would flow into and through these trap compartments 180, 181, 182 in the following sequence, heater connection duct 121, compartment 180, passage 153, arrow 190, passage 173, arrow 191, compartment 181, passage 157, arrow 192, passage 177, arrow 193, compartment 182, passage 163, arrow 194, into chimney leg 127 and then to the chimney connection 125 of the shroud duct 124 via arrow 195.

The double headed arrow 196 in the shroud 124 and chimney connection 125 represent air flow from the chimney into environ space 137 or air flow from environ space 137 to the chimney.

From the foregoing the trap compartments 180 and 181 provide two heads of pressure h+h while the trap compartment 182 and the chimney leg duct 127 provides a larger head of pressure H. We now have a choking heat of h+h+H which as previously explained relative to my application Ser. No. 866,458, U.S. Pat. No. 4,215,814, this would be an improved choking of two and three eights to one. This materially aids the hot passive air/gas to stratify and trap the passage of air/-gas.

This form of the invention has been provided with an outer housing 200 encompassing but spaced therefrom to provide a thin air space 205. This air space 205 can be used to insulate the housing 113 by trapped air in the space 205 or it can be used to act as a heat exchanger unit when used with a furnace having a hot air circulating system.

An air inlet 206 is provided as well as an air outlet 207 in the housing 200 and the outlet 207 is connected to the cold air return of the system. When the furnace is ON, environ air is drawn into the housing through inlet 206, the air is heated by the walls 114, 115, and 116 and drawn into the circulating system to have the heat reclaimed, adding to the efficiency of the furnace.

Suitable means for holding the trap 113 to a heater 110 may be used such as ears 210 on the base plate 117 and sheet metal screws 211.

FIG. 8 shows another form of the invention wherein similiar parts are numbered with the prefix 3. Here the chimney connection 325 passes through the top wall 314 of the housing 313 and projects downwardly into the chimney leg duct 327 by the dividing wall 360' to shroud 324 at the base plate 317. Otherwise it is about identical to the form of the invention shown in FIGS. 5, 6 and 7. It should also be noted that here in FIG. 8 is shown a construction wherein all of the walls 314, 315, 316, the baffles 350, 332, 360 might be made integral and monolithic, all of the walls molded into one.

Another form of construction for trap 13 is illustrated in the FIGS. 9–13 wherein all similar parts are numbered having the prefix 4.

As clearly shown in FIG. 12 the base plate 417 of the housing 413', 413" of the trap 412 in this instance has two upstanding side walls 415, 415, the two openings 420 and 423 and periferal fastenings 418 on all of its edges. In FIG. 13 the top plate 414 has two downstanding side walls 416, 416. The top wall 414 and the side walls 416 can have the baffle plates 450, 460 and 470 fastened to them in any suitable manner. A fastening lug may extend from the base plate 413" to hold the trap onto the heater 410 by a screw 411, with a gasket 475 to make the mounting gas tight.

A swiveling shroud 424 is shown in FIG. 9 with its flared mounting 426 in the opening 423 for connection to a chimney by its chimney connection 425.

Housing part 413" is fabricated as shown in FIG. 12 with the shroud 424 added and the periferal edges formed into the fastenings 418. Housing part 413' is fabricated with the baffles 450, 460, 470 and then assembeled to the part 413" by inserting its periferal edges into the fastenings 418 on part 413". The upper ends of the side walls 415, 415 are sprung away from each other to allow housing part 413' to seat into the fastenings 418 and when part 413' is down all the way into the fastenings 418, the side walls 415,415 are moved toward each other to complete the engagement of the top plate edges 414, 414 into the fastenings 418 to retain and seal all of the periferal edges of the part 413' to complete the assembly and form the chamber 422.

This just described construction has a minimum of wasted material, it being the material stamped out of the opening 420 and 423. It also has the maximum of enclosed gas volume within its outside dimensions.

From the forgoing descriptions and illustrations it should be apparent that a very compact flue gas trap is shown that will more effectively choke off lost heat from a heater because of its multiple choke effect in a space saving arrangement.

The terms and expressions which have been employed are used as terms of description and not of limitation, and there is no intention, in the use of such terms and expressions, of excluding any equivalents of the features shown and described, or portions thereof, it being recognized that various modifications are possible within the scope of the invention claimed.

What is claimed is:

1. A descrete hot gas trap attachment for connection between the outlet flue of a heater in an environ space and a chimney to either vent hot flowing gasses freely from said outlet flue to said chimney or to choke hot passive gasses from said outlet flue to said chimney comprising an elongated horizontal housing including a base plate and a top plate connected to each other by sidewalls for defining a horizontal choke chamber having at least one partition depending from said top plate to partially divide said choke chamber into at least a first compartment and a last compartment connected by a passage near the base plate, a heater connection duct projecting upwardly into said first compartment from the upper side of said base plate for connection to said outlet flue, a chimney leg duct projecting upwardly into said last compartment from the upper side of said base plate, said chimney leg duct having communication with a shroud portion depending from the underside of said base plate with its lower end open to said environ space, said shroud portion having a chimney connection at or below said base plate for venting said outlet flue to said chimney to vent hot flowing gasses freely or for venting said environ space to said chimney to choke hot passive gasses from said outlet flue.

2. A hot gas trap as in claim 1 wherein, said chimney connection passes downwardly through said top wall of said horizontal choke chamber to said shroud portion, with its lowermost open end at or below said base plate.

3. A hot gas trap as in claim 1 wherein, said horizontal choke chamber has a covering to thermally insulate its walls from said environ space air.

4. A hot gas trap as in claim 1 further comprising, a housing enclosing said horizontal choke chamber and spaced therefrom to provide an air space between said housing and said horizontal choke chamber to insulate the walls of said horizontal choke chamber from said environ air.

5. A hot gas trap as in claim 4 wherein, said housing has an inlet for the entry of environ air and an exit for connection to a low pressure source to remove heated air from said air space.

6. A hot gas trap as in claim 1 wherein, said heater connection duct is formed by a first baffle plate with said sidewalls of said first compartment and wherein said chimney leg duct is formed by a last baffle plate with said sidewalls of said last compartment.

7. A hot gas trap as in claim 6 wherein, said first and said last baffle plates are fastened to said side walls.

8. A hot gas trap as in claim 6 wherein, said first and said last baffle plates are fastened to said base plate.

9. A hot gas trap as in claim 1 wherein, said horizontal choke chamber is formed from a single sheet bent to form said sidewalls with the gussets formed thereby, folded alongside of said sidewalls.

10. A hot gas trap as in claim 1 wherein, said elongated horizontal housing is formed en-bloc as a monolithic entity, for attachment to said base plate.

11. A hot gas trap as in claim 1 wherein, said top plate is unitary with a pair of said sidewalls and wherein said base plate is unitary with another pair of said side walls, with all of the periferal edges of said top plate having mating connection with all of the periferal edges of said base plate.

* * * * *

UNITED STATES PATENT AND TRADEMARK OFFICE

CERTIFICATE OF CORRECTION

PATENT NO. : 4,320,869

DATED : March 23, 1982

INVENTOR(S) : Edward A. Ebert

It is certified that error appears in the above-identified patent and that said Letters Patent are hereby corrected as shown below:

On the face of the patent change

"[*] Notice: The portion of the term of this patent subsequent to Aug. 5, 1977, has been disclaimed." to --[*] Notice: The portion of the term of this patent subsequent to Aug. 5, 1997, has been disclaimed.--

Column 1, line 15, change "not" to --hot--.

Column 3, line 68, change "any" to --my--.

Signed and Sealed this

*Eighth* Day of *June 1982*

|SEAL|

*Attest:*

GERALD J. MOSSINGHOFF

*Attesting Officer*

*Commissioner of Patents and Trademarks*